US009704445B2

(12) United States Patent
Shi et al.

(10) Patent No.: US 9,704,445 B2
(45) Date of Patent: Jul. 11, 2017

(54) TIME-DELAYED DISCHARGE CIRCUITS FOR DISPLAY PANELS AND DISPLAY DEVICES

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Wensen Shi, Beijing (CN); Shuai Xu, Beijing (CN); Zhiyong Wang, Beijing (CN); Yi Zheng, Beijing (CN); Zhengxin Zhang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 360 days.

(21) Appl. No.: 14/492,865

(22) Filed: Sep. 22, 2014

(65) Prior Publication Data

US 2015/0262540 A1 Sep. 17, 2015

(30) Foreign Application Priority Data

Mar. 12, 2014 (CN) ..... 2014 1 0090663

(51) Int. Cl.
*G09G 3/36* (2006.01)

(52) U.S. Cl.
CPC ... *G09G 3/3648* (2013.01); *G09G 2310/0251* (2013.01); *G09G 2330/027* (2013.01)

(58) Field of Classification Search
CPC ..... G09G 3/3648; G09G 2330/027; G09G 2310/0251
USPC ..... 345/87, 92
See application file for complete search history.

(56) References Cited

U.S. PATENT DOCUMENTS

2003/0071943 A1* 4/2003 Choo ..... G02F 1/133514 349/106
2006/0033685 A1 2/2006 Lee et al.
2006/0066550 A1* 3/2006 Huang ..... G09G 3/3648 345/92

(Continued)

FOREIGN PATENT DOCUMENTS

CN 1420483 A 5/2003
CN 1945682 A 4/2007

(Continued)

OTHER PUBLICATIONS

First Office Action regarding Chinese application No. 201410090663.7, dated Dec. 4, 2015. Translation provided by Dragon Intellectual Property Law Firm.

*Primary Examiner* — Jonathan Blancha
(74) *Attorney, Agent, or Firm* — Harness, Dickey & Pierce, P.L.C.

(57) ABSTRACT

The present disclosure relates to a discharge circuit of a display panel and a display device, and the discharge circuit of the display panel includes a time-delay control module configured to output a discharge control signal for a predetermined time period after the display panel is powered off, and a grounding module configured to receive the discharge control signal and enable a signal line to be grounded for the predetermined time period based on the discharge control signal.

19 Claims, 5 Drawing Sheets

(56) References Cited

U.S. PATENT DOCUMENTS

| | | | | |
|---|---|---|---|---|
| 2008/0180429 | A1* | 7/2008 | Park | G09G 3/3648 345/211 |
| 2011/0012888 | A1* | 1/2011 | Ko | G09G 3/3648 345/212 |
| 2012/0280961 | A1* | 11/2012 | Son | G09G 3/3685 345/211 |
| 2013/0147697 | A1* | 6/2013 | Sung | G02F 1/136204 345/87 |
| 2013/0285986 | A1* | 10/2013 | Haga | G06F 3/0412 345/175 |
| 2014/0062935 | A1* | 3/2014 | Bi | G06F 3/0418 345/174 |

FOREIGN PATENT DOCUMENTS

| | | | |
|---|---|---|---|
| CN | 101383133 | A | 3/2009 |
| CN | 102522063 | A | 6/2012 |
| CN | 103218967 | A | 7/2013 |
| CN | 103412427 | A | 11/2013 |
| KR | 1020050034768 | A | 4/2005 |
| KR | 20070079643 | A | 8/2007 |

* cited by examiner

TIME-DELAYED DISCHARGE CIRCUITS FOR DISPLAY PANELS AND DISPLAY DEVICES

CROSS-REFERENCE TO RELATED APPLICATION

This application claims priority to Chinese Patent Application No. 201410090663.7 filed on Mar. 12, 2014, the disclosures of which are incorporated in their entirety by reference herein.

TECHNICAL FIELD

The present invention relates to the technical field of display, and in particular to a discharge circuit of a display panel and a display device.

BACKGROUND

The liquid crystal display (LCD) is widely used for a display device such as a television, a display, a laptop, a tablet computer and a mobile internet apparatus due to the advantages of a small size, low power consumption and a long life thereof.

The conventional design for a display panel is prone to cause charge accumulation, which makes the display panel appear an undesirable phenomenon such as a greenish phenomenon and a residual image, seriously affecting the display effect of the display panel. Thus, a discharge circuit is needed which enables the display panel to discharge rapidly in a standby mode.

SUMMARY

The technical problem to be solved by the present disclosure is that the display panel is prone to have the issue of charge accumulation.

For this purpose, the present disclosure provides a discharge circuit of a display panel including a time-delay control module configured to output a discharge control signal for a predetermined time period after the display panel is powered off; and a grounding module configured to receive the discharge control signal and enable a signal line to be grounded for the predetermined time period based on the discharge control signal.

Alternatively, the time-delay control module comprises a time-delay unit and a first switch, wherein one end of the first switch is coupled to the time-delay unit and the other end of the first switch is coupled to the grounding module.

Alternatively, the time-delay unit is configured to keep a high level signal before the display panel is powered off for the predetermined time period, the first switch is turned on when the display panel is powered off so that the high level signal sent by the time-delay unit is transmitted to the grounding module as the discharge control signal.

Alternatively, the first switch comprises a first MOS transistor, wherein a gate electrode of the first MOS transistor is coupled to a power supply of the display panel, a source electrode of the first MOS transistor is coupled to the grounding module, and a drain electrode of the first MOS transistor is coupled to the time-delay unit.

Alternatively, the time-delay control module further comprises an inverter in the case that the first MOS transistor is an N-type MOS transistor, wherein the inverter is coupled between the power supply of the display panel and the gate electrode of the first MOS transistor.

Alternatively, the grounding module comprises a signal line switch, wherein the signal line switch is turned on for the predetermined time period when the discharge control signal is received so that the signal line is grounded.

Alternatively, the grounding module comprises a plurality of signal line switches and there are a plurality of signal lines, wherein the one of plurality of signal line switches are coupled to the corresponding one of the plurality of signal lines and the ground, the plurality of signal line switches are all turned on for the predetermined time period when the discharge control signal is received, so that the plurality of signal lines corresponding to the plurality of signal line switches are all grounded.

Alternatively, the plurality of signal lines comprise a gate line, a data line and a common electrode line.

Alternatively, the plurality of signal line switches comprises a second switch, a third switch and a fourth switch, wherein the second switch is coupled to the gate line and the ground, the third switch is coupled to the data line and the ground, the fourth switch is coupled to the common electrode line and the ground, and the second switch, the third switch and the fourth switch are turned on simultaneously for the predetermined time period when the discharge control signal is received so that the gate line, the data line and the common electrode line are all grounded.

Alternatively, the second switch comprises a second MOS transistor, the third switch comprises a third MOS transistor, and the fourth switch comprises a fourth MOS transistor.

Alternatively, gate electrodes of the second MOS transistor, the third MOS transistor and the fourth MOS transistor are coupled to the time-delay control module; source electrodes of the second MOS transistor, the third MOS transistor and the fourth MOS transistor are respectively coupled to the gate line, the data line and the common electrode line; and drain electrodes of the second MOS transistor, the third MOS transistor and the fourth MOS transistor are grounded.

Alternatively, the grounding module further comprises an inverter in the case that the second MOS transistor, the third MOS transistor and the fourth MOS transistors are all P-type MOS transistors, wherein the inverter is coupled between the time-delay control module and the gate electrodes of the second MOS transistor, the third MOS transistor and the fourth MOS transistor.

Alternatively, the second MOS transistor comprises three MOS transistors for controlling RGB data signal lines respectively.

Alternatively, the discharge circuit further comprising a gate line switch and a data line switch, wherein the gate line switch and the data line switch are turned on when the discharge control signal is received so that a gate voltage is loaded onto the gate line and a data signal is loaded onto the data line.

The present invention further provides a display device comprising the discharge circuit of the display panel described above.

By applying the discharge circuit of the display panel disclosed in the present invention, the gate line, the data line and the common electrode line of the display panel are grounded simultaneously to achieve the purpose of discharge, and thus charge accumulation for a long time may be avoided by performing one time discharge operation when the display panel is in standby mode.

BRIEF DESCRIPTION OF THE DRAWINGS

Features and advantages of the present invention will become more clearly with reference to the accompanying drawings, and the drawings are intend to illustrate and should not be construed as any limitation on the present invention, in which.

DETAILED DESCRIPTION

Embodiments of the present invention will be described in detail hereinafter in conjunction with the drawings.

Figure 1:
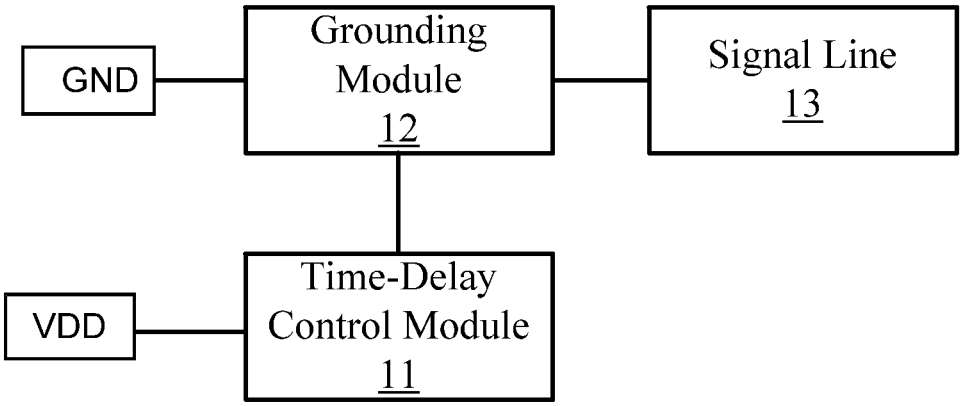
FIG. 1 is a block diagram showing a discharge circuit according to an embodiment of the present invention.

FIG. 1 is a block diagram showing a discharge circuit according to an embodiment of the present invention. As shown in FIG. 1, the discharge circuit of a display panel according to an embodiment of the present invention includes a time-delay control module 11 and a grounding module 12, wherein the time-delay control module 11 is coupled to a power supply VDD of the display panel and configured to output a discharge control signal for a predetermined time period after the display panel is powered off, i.e., the power supply VDD of the display panel is decreased to zero, and the grounding module 12 is configured to receive the discharge control signal and enable a signal line 13 to be grounded for the predetermined time period based on the discharge control signal.

By applying the discharge circuit of the display panel disclosed in the present invention, the signal lines of the display panel are enabled to be grounded simultaneously to achieve the purpose of discharge, and thus charge accumulation for a long time may be avoided by performing one time discharge operation when the display panel is in standby mode.

Figure 2:
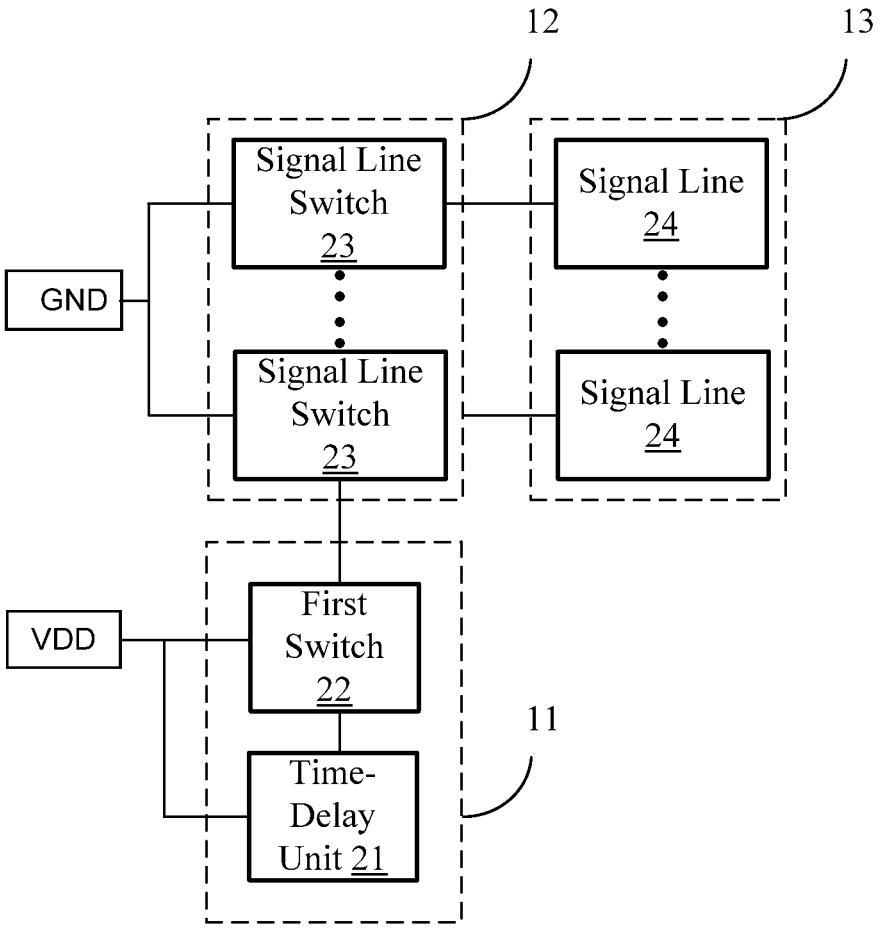
FIG. 2 is a detail block diagram showing the discharge circuit according to an embodiment of the present invention.

FIG. 2 is a detailed block diagram showing the discharge circuit according to an embodiment of the present invention. As shown in FIG. 2, the time-delay control module 11 includes a time-delay unit 21 and a first switch 22, wherein one end of the first switch 22 is coupled to the time-delay unit 21 and the other end thereof is coupled to a grounding module 12, the time-delay unit 21 is configured to keep a high level signal VDD before the display panel is powered off for a predetermined time period, and the first switch 22 is turned on when the display panel is powered off so that the high level signal sent by the time-delay unit 21 is transmitted to the grounding module 12 as the discharge control signal. The grounding module 12 includes at least one signal line switch 23, which is turned on for the predetermined time period when the discharge control signal is received so that at least one signal line 24 corresponding to the at least one signal line switch 23 is grounded. In order to discharge the circuit completely, for example, the signal line switches 23 are all turned on for the predetermined time when the discharge control signal is received, so that the corresponding signal lines 24 are all grounded. More specifically, the signal line 24 is at least one of a gate line, a data line and a common electrode line of the display panel.

It should be noted that a conventional time-delay relay may be applied as the time-delay unit, where a specific length of delay time may be selected and set as required.

Hereinafter, in the case that the signal lines includes a gate line, a data line and a common electrode line of the display panel and the corresponding signal line switches 23 include three switches, i.e., a second switch 232, a third switch 233 and a fourth switch 234, the specific embodiments of the present invention will be described hereinafter.

Figure 3:
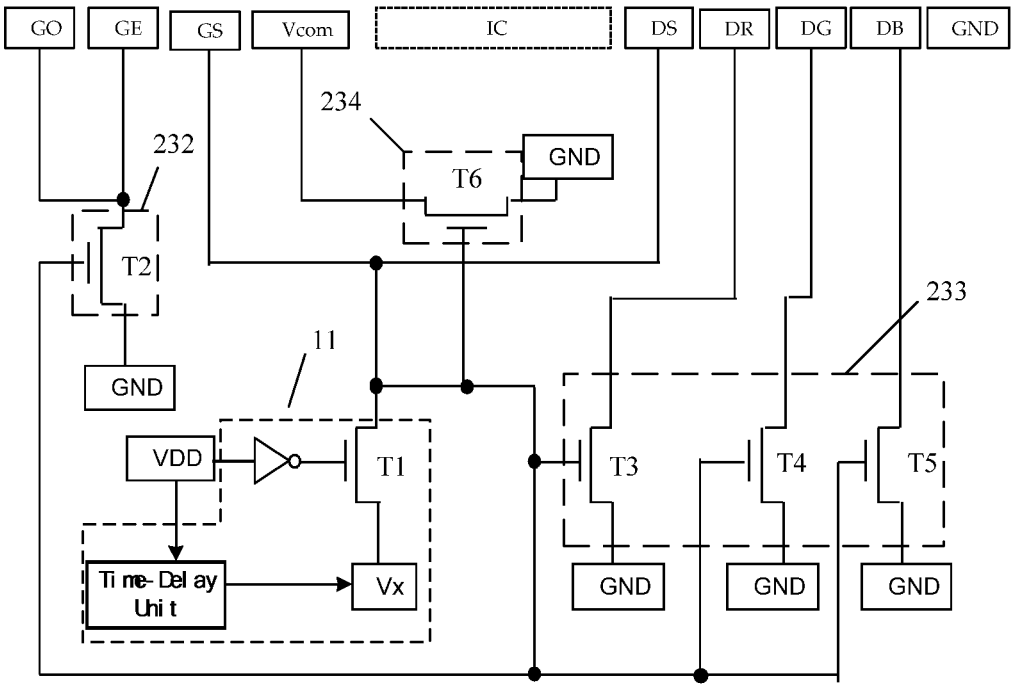
FIG. 3 is a schematic diagram showing the discharge circuit according to an embodiment of the present invention.

FIG. 3 is a schematic diagram showing the discharge circuit according to the embodiment of the present invention. In FIG. 3, transistors T1 to T6 are N-type MOS transistors, and the power supply VDD of the display panel is coupled to a gate electrode of the transistor T1 (i.e., the first switch) via an inverter and is coupled to a drain electrode of the transistor T1 via the time-delay unit. A source electrode of the transistor T1 is coupled to a data line switch DS, a gate line switch GS, a gate electrode of the transistor T2 (i.e., the second switch), gate electrodes of the transistors T3, T4 and T5 (i.e., the third switch), and a gate electrode of the transistor T6 (i.e., the fourth switch). A source electrode of the transistor T2 is coupled to an odd-row gate line GO and an even-row gate line GE, source electrodes of the transistors T3, T4 and T5 are respectively coupled to RGB data lines DR, DG and DB, a source electrode of the transistor T6 is coupled to a common electrode line Vcom, and drain electrodes of the transistors T2 to T6 are grounded.

When the display panel is in standby mode, the power supply VDD of the display panel is powered off, e.g., the voltage is changed from 3V to 0V. In this case, the output of a NOT gate coupled to the VDD is a high level so that the transistor T1 is turned on, and the VDD is delayed by the time-delay unit so that voltage Vx (i.e., the voltage at the drain electrode of the transistor T1) remains at a high level (3V) for a predetermined time period, e.g., the delay time is 50 μs. Since the transistor T1 is in an on-state at this time, the high level Vx at the drain electrode of the transistor T1 pulls up the voltage of the data line switch DS and the gate line switch GS coupled to the source electrode of the transistor T1 so that the data line switch DS and the gate line switch GS are turned on, and thus the gate voltage may be loaded onto the gate line and the RGB data signal may be loaded onto the data line.

Since the source electrode of the transistor T1 is at a high level, the transistors T2, T3, T4, T5 and T6 are turned on. Since the transistor T2 is turned on, the odd-row gate line GO and the even-row line GE are ground. For the display circuit, the odd-row gate line and even-row gate line are generally laid out on different layers separately to improve space utilization. It should be understood by those skilled in the art that there may be provided only one gate line in the case of sufficient space. Since the transistors T3, T4 and T5 are turned on, the RGB data signal lines DR, DG and DB are grounded respectively. Since the transistor T6 is turned on, the common electrode line Vcom is grounded. Thus, when the VDD is powered off, the discharge circuit according to the embodiment of the present invention enables the gate line, the data line and the common electrode line of the display panel to be grounded simultaneously to achieve the purpose of discharge, and thus charge accumulation for a long time may be avoided by performing one time discharge operation when the display panel is in standby mode.

After the time-delay operation of the time-delay unit ends, the voltage Vx is at a low level, thus the data line switch DS and the gate line switch GS are at all the low level so that the gate voltage GO/GE would not be loaded onto the gate line and the RGB data signal DR/DG/DB would not be loaded onto the data line, and at the same the transistors T2, T3, T4, T5 and T6 are turned off so that the RGB data signal lines DR, DG and DB, the odd-row gate line GO and the even-row gate line GE, and the common electrode line Vcom would not be grounded. Then the discharge process ends.

Figure 4:
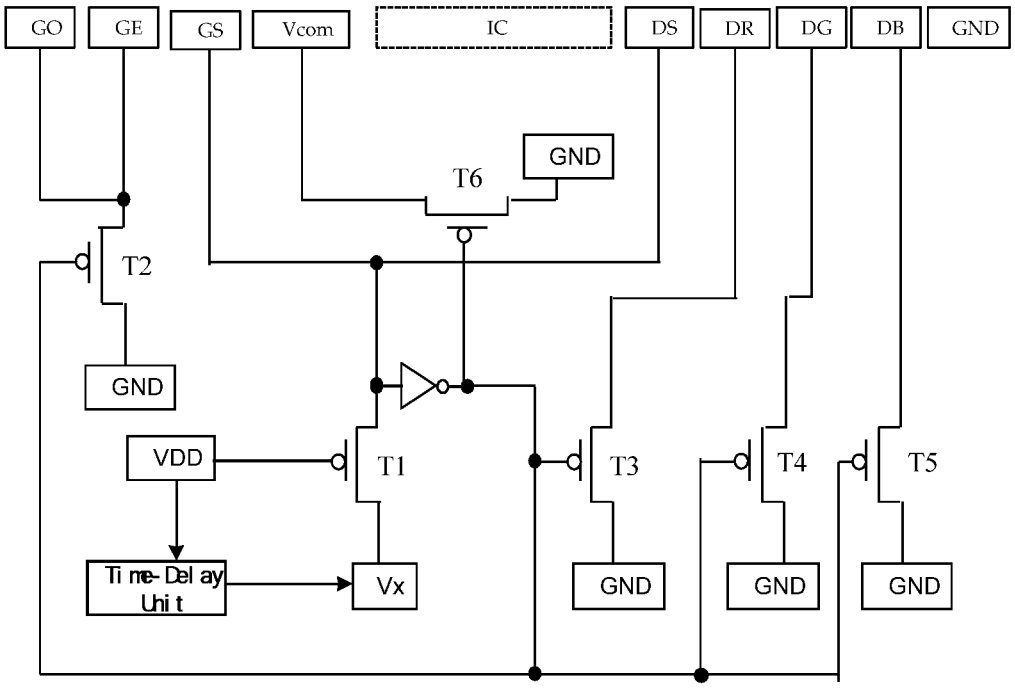
FIG. 4 is a schematic diagram showing a discharge circuit according to another embodiment of the present invention.

The transistors in the discharge circuit described above are all N-type MOS transistors, for example thin film transistors (TFTs). It should be understood that the transistors in the discharge circuit according to the present disclosure are not limited to N-type MOS transistors, and may be P-type MOS transistors. FIG. 4 is a schematic diagram showing a discharge circuit according to another embodiment of the present invention, in which the transistors T1 to T6 are all P-type MOS transistors.

Similar to the previous embodiment, the transistor T1 is turned on after the VDD is powered off, and the VDD is delayed by the time-delay unit so that the voltage Vx at the drain electrode of the transistor T1 remains at a high level, thus the data line switch DS and the gate line switch GS is pulled up, and the gate voltage may be loaded onto the gate line and the RGB data signal may be loaded onto the data line. The high level at the source electrode of the transistor T1 is changed into a low level by the NOT gate coupled to the transistor T1 so that the transistors T2 and T6 are turned on. Thus, the gate line is grounded by the transistor T2, the data line is grounded by the transistors T3, T4 and T5, and the common electrode line is grounded by the transistor T6. After the time-delay operation of the time-delay unit ends, the voltage Vx is at a low level so that the data line switch DS and the gate line switch GS are all at a low level and thus the gate voltage GO/GE would not be loaded onto the gate line and the RGB data signal DR/DG/DB would not be loaded onto the data line, and at the same the transistors T2 and T6 are turned off and thus the gate line, the data line and the common electrode line would not be grounded. Then the discharge process ends.

Figure 5:
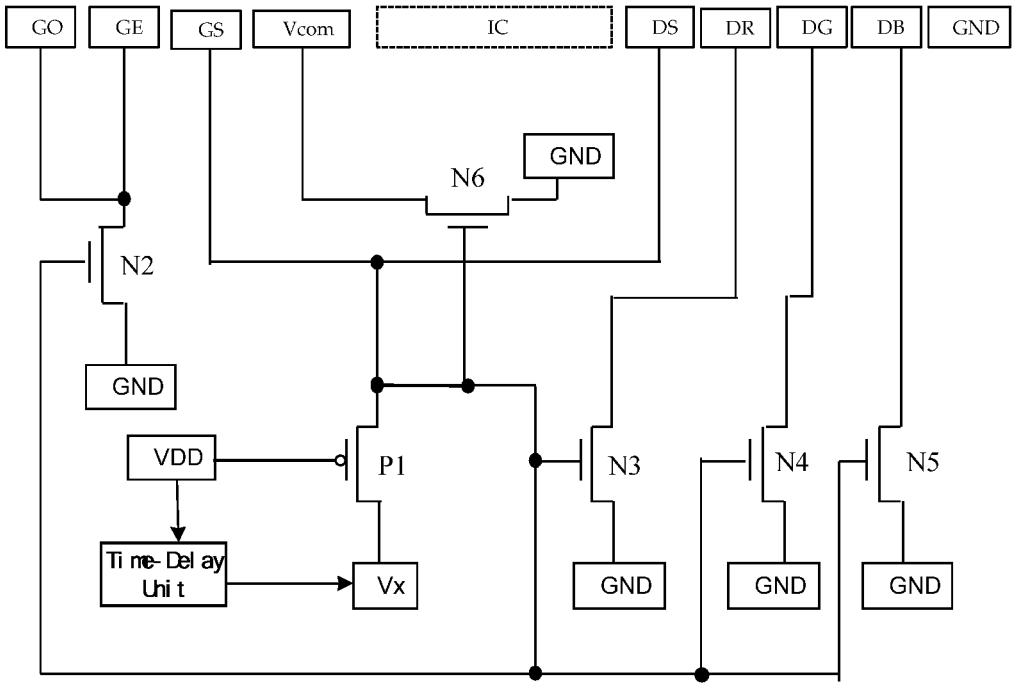
FIG. 5 is a schematic diagram showing a discharge circuit according to yet another embodiment of the present invention.

FIG. 5 is a schematic diagram showing a discharge circuit according to yet another embodiment of the present invention, in which the NOT gate in the foregoing embodiments is omitted and thus the circuit configuration of the discharge circuit is further simplified. As shown in FIG. 5, transistor P1 is a P-type MOS transistor, and transistors N2 to N6 are N-type MOS transistors. After the VDD is powered off, the transistor P1 is turned on, and the VDD is delayed by the time-delay unit so that the voltage Vx at the drain electrode of the transistor P1 remains at a high level, and thus the voltage of the data line switch DS and the voltage of the gate line switch GS are pulled up so that the gate voltage may be loaded onto the gate line and the RGB data signal may be loaded onto the data line. The transistors N2 to N6 are turned on due to the high level at the source electrode of the transistor P1. Thus, the gate line is grounded by the transistor N2, the data lines are grounded by the transistors N3, N4 and N5, and the common electrode line is grounded by the transistor N6. After the time-delay operation of the time-delay unit ends, the voltage Vx is at a low level, thus the data line switch DS and the gate line switch GS are at a low level so that the gate voltage GO/GE would not be loaded onto the gate line and the RGB data signal DR/DG/DB would not be loaded onto the data line, and at the same time the transistors N2 to N6 are turned off so that the gate line, the data line and the common electrode line would not be grounded. Then the discharge process ends.

The above embodiments are only used to illustrate the present invention, and are not intended to be exhaustive or to limit the present invention. Upon reading the present invention, those skilled in the art can make various changes and modifications to the present invention. For example, changes and modifications, such as applying other electronic element as a switch element, applying other delay mode, or changing the type of MOS transistor and changing the circuit configuration accordingly, are within the scope of the present invention.

By applying the discharge circuit of the display panel according to the present invention, the gate line, the data line and the common electrode line of the display panel are grounded simultaneously to achieve the purpose of discharge, and thus charge accumulation for a long time may be avoided by performing one time discharge operation when the display panel is in standby mode.

The present invention further provides a display device including the discharge circuit of the display panel described above. The display device may be a LCD panel, an electronic paper, an OLED panel, a mobile phone, a tablet computer, a television, a display, a laptop, a digital photo frame, a navigation system and any other product or component with a display function.

While the embodiments of the present invention are described in conjunction with the drawings, various modifications and variations may be made to the present invention by those skilled in the art without departing from the spirit and scope of the present invention, and these modifications and variations should be within the scope as defined by the appended claims.

What is claimed is:

1. A discharge circuit of a display panel, comprising:

a time-delay control module configured to output a discharge control signal for a predetermined time period after the display panel is powered off; and a grounding module configured to receive the discharge control signal and enable a signal line to be grounded for the predetermined time period based on the discharge control signal, wherein:

the time-delay control module comprises a time-delay unit and a first switch, a first end of the first switch is coupled to the time-delay unit, and a second end of the first switch is coupled to the grounding module.

2. The discharge circuit according to claim 1, wherein:

the time-delay unit is configured to keep a high level signal before the display panel is powered off for the predetermined time period and the first switch is turned on when the display panel is powered off so that the high level signal sent by the time-delay unit is transmitted to the grounding module as the discharge control signal.

3. The discharge circuit according to claim 1, wherein:

the first switch comprises a first MOS transistor, a gate electrode of the first MOS transistor is coupled to a power supply of the display panel, a source electrode of the first MOS transistor is coupled to the grounding module, and a drain electrode of the first MOS transistor is coupled to the time-delay unit.

4. The discharge circuit according to claim 3, wherein:

the time-delay control module further comprises an inverter, the first MOS transistor is an N-type MOS transistor, and the inverter is coupled between the power supply of the display panel and the gate electrode of the first MOS transistor.

5. The discharge circuit according to claim 1, wherein:

the grounding module comprises a signal line switch and the signal line switch is turned on for the predetermined time period when the discharge control signal is received so that the signal line is grounded.

6. The discharge circuit according to claim 1, wherein:

the grounding module comprises a plurality of signal line switches corresponding to a plurality of signal lines including the signal line, and each one of the plurality of signal line switches is coupled to a corresponding one of the plurality of signal lines and a ground, and the plurality of signal line switches are all turned on for the predetermined time period when the discharge control signal is received, so that the plurality of signal lines corresponding to the plurality of signal line switches are all grounded.

7. The discharge circuit according to claim 6, wherein the plurality of signal lines comprise a gate line, a data line, and a common electrode line.

8. The discharge circuit according to claim 7, wherein:

the plurality of signal line switches comprise a second switch, a third switch, and a fourth switch, and the second switch is coupled to the gate line and the ground, the third switch is coupled to the data line and the ground, the fourth switch is coupled to the common electrode line and the ground, and the second switch, the third switch, and the fourth switch are turned on simultaneously for the predetermined time period when the discharge control signal is received so that the gate line, the data line, and the common electrode line are all grounded.

9. The discharge circuit according to claim 8, wherein:

the second switch comprises a second MOS transistor, the third switch comprises a third MOS transistor, and the fourth switch comprises a fourth MOS transistor.

10. The discharge circuit according to claim 9, wherein:

gate electrodes of the second MOS transistor, the third MOS transistor, and the fourth MOS transistor are coupled to the time-delay control module;

source electrodes of the second MOS transistor, the third MOS transistor, and the fourth MOS transistor are respectively coupled to the gate line, the data line, and the common electrode line; and drain electrodes of the second MOS transistor, the third MOS transistor, and the fourth MOS transistor are grounded.

11. The discharge circuit according to claim 10, wherein:

the grounding module further comprises an inverter the second MOS transistor, the third MOS transistor, and the fourth MOS transistor are all P-type MOS transistors, and the inverter is coupled between the time-delay control module and the gate electrodes of the second MOS transistor, the third MOS transistor, and the fourth MOS transistor.

12. The discharge circuit according to claim 9, wherein:

the third switch further comprises a fifth MOS transistor and a sixth MOS transistor and the third MOS transistor, the fifth MOS transistor, and the sixth MOS transistor are connected to a red data signal line, a green data signal line, and a blue signal line, respectively.

13. The discharge circuit according to claim 7, further comprising a gate line switch and a data line switch, wherein the gate line switch and the data line switch are turned on when the discharge control signal is received so that a gate voltage is loaded onto the gate line and a data signal is loaded onto the data line.

14. The discharge circuit according to claim 8, further comprising a gate line switch and a data line switch, wherein the gate line switch and the data line switch are turned on when the discharge control signal is received so that a gate voltage is loaded onto the gate line and a data signal is loaded onto the data line.

15. The discharge circuit according to claim 9, further comprising a gate line switch and a data line switch, wherein the gate line switch and the data line switch are turned on when the discharge control signal is received so that a gate voltage is loaded onto the gate line and a data signal is loaded onto the data line.

16. The discharge circuit according to claim 10, further comprising a gate line switch and a data line switch, wherein the gate line switch and the data line switch are turned on when the discharge control signal is received so that a gate voltage is loaded onto the gate line and a data signal is loaded onto the data line.

17. The discharge circuit according to claim 11, further comprising a gate line switch and a data line switch, wherein the gate line switch and the data line switch are turned on when the discharge control signal is received so that a gate voltage is loaded onto the gate line and a data signal is loaded onto the data line.

18. The discharge circuit according to claim 12, further comprising a gate line switch and a data line switch, wherein the gate line switch and the data line switch are turned on when the discharge control signal is received so that a gate voltage is loaded onto the gate line and a data signal is loaded onto the data line.

19. A display device, comprising the discharge circuit of the display panel according to claim 1.

* * * * *